United States Patent [19]

Tojo et al.

[11] 4,365,941

[45] Dec. 28, 1982

[54] SCROLL COMPRESSOR PROVIDED WITH MEANS FOR PRESSING AN ORBITING SCROLL MEMBER AGAINST A STATIONARY SCROLL MEMBER AND SELF-COOLING MEANS

[75] Inventors: Kenji Tojo, Oaza Shimoinayoshi; Taisei Hosoda, Ohiramachi; Masato Ikegawa; Masao Shiibayashi, both of Oaza Shimoinayoshi, all of Japan

[73] Assignee: Hitachi, Ltd., Tokyo, Japan

[21] Appl. No.: 145,574

[22] Filed: Apr. 30, 1980

[30] Foreign Application Priority Data

May 9, 1979 [JP] Japan ..... 54-55732

[51] Int. Cl.[3] ..... F04B 35/04; F04B 39/06; F04B 39/12; F04C 18/02

[52] U.S. Cl. ..... 417/372; 417/410; 417/902; 418/55; 418/57; 418/83; 418/88

[58] Field of Search ..... 418/55, 57, 83, 88; 417/366, 372, 902, 410

[56] References Cited

U.S. PATENT DOCUMENTS 2,517,367 8/1950 Winkler ..... 417/902
3,285,504 11/1966 Smith ..... 417/902
3,317,123 5/1967 Funke ..... 418/88
3,514,225 5/1970 Monden et al. ..... 417/902
4,216,661 8/1980 Tojo et al. ..... 418/55

FOREIGN PATENT DOCUMENTS 2812594 10/1978 Fed. Rep. of Germany ..... 418/55

*Primary Examiner*—John J. Vrablik
*Attorney, Agent, or Firm*—Antonelli, Terry & Wands

[57] ABSTRACT

A scroll compressor for compressing a gas to a high pressure or for use in a refrigeration system such as a refrigerator, freezer, air conditioner or the like, is provided. In the compressor, a compressor unit and its driving motor is enclosed gas-tightly in a casing, and the compressor unit is provided with a backpressure chamber into which is introduced a partially compressed gas so as to press an orbiting scroll member against a stationary scroll member. The compressed gas discharged from the compressor unit is circulated through component parts such as the motor enclosed in the casing before it flows into a next stage outside of the compressor. With the above arrangement, the separation of the orbiting scroll member from the stationary scroll member due to the gas pressure is prevented to thereby attaining a secure axial seal between them, and also the motor is satisfactorily cooled.

11 Claims, 3 Drawing Figures

SCROLL COMPRESSOR PROVIDED WITH MEANS FOR PRESSING AN ORBITING SCROLL MEMBER AGAINST A STATIONARY SCROLL MEMBER AND SELF-COOLING MEANS

BACKGROUND OF THE INVENTION

1. Field of the Invention

The present invention relates to a scroll compressor for compressing a gas to a high pressure or for use in a compression type refrigeration system such as a refrigerator, freezer, air conditioner or the like, and more particularly a means for pressing an orbiting scroll member against a stationary scroll member and a means for cooling the chamber of the scroll compressor.

2. Description of the Prior Art

In the refrigeration systems such as refrigerators, freezers, air conditioners and so on comprising a refrigerant compression means, a condenser, an expansion means and an evaporator, the scroll compressors are increasingly used as a compression means. Same is true for the compressors for compressing gases to high pressures.

In the scroll compressor, a stationary scroll member consisting of an end plate and an involute wrap and formed with a suction and discharge ports and an orbiting scroll member also consisting of an end plate and an involute wrap are internally meshed with each other. A rotation-preventive means or Oldham ring is interposed between the orbiting scroll member and the stationary scroll member or a casing means. The orbiting scroll member is drivingly connected to a drive shaft so that the orbiting scroll member is forced to make the orbiting motion relative to the stationary scroll member, whereby the spaces sealed between the stationary and orbiting scroll members are forced to reduce their volumes and consequently the gases in these spaces or compression chambers are forced to be compressed. A scroll compressor, an expansion device and a pump of the type described above are disclosed in detail in U.S. Pat. No. 3,884,599.

In the scroll type hydraulic equipment such as a scroll compressor, an expansion device or a pump, as the gas trapped in the spaces between the stationary and orbiting scroll members is forced to flow toward the axis of rotation thereof, the pressure of the gas is gradually increased. As a result, the raised or increased pressure tend to separate the stationary and orbiting scroll members from each other. When they are separated from each other in the axial direction, the gas entrapped between them escapes through an annular space between them so that the compression efficiency considerably drops.

There have been proposed various schemes for preventing the axial separation between the stationary and orbiting scroll members, thereby maintaining the secure axial sealing therebetween. For instance, according to U.S. Pat. No. 2,881,089, spring means are interposed between the orbiting scroll member and a casing so as to press the orbiting scroll member against the stationary scroll member. U.S. Pat. No. 3,600,114 proposes that the discharged or compressed gas is forced to flow into the space behind the orbiting scroll member, thereby pressing the latter against the stationary scroll member. According to the commonly assigned co-pending U.S. application, Ser. No. 887,252, now abandoned, the compressed gas is bypassed into the interior of a casing from the intermediate compression chambers so that the orbiting scroll member is pressed against the stationary scroll member under the force of this partially compressed gas. In addition, the commonly assigned co-pending U.S. application, Ser. No. 967,893 discloses that the partially compressed gas is forced to flow from the intermediate compression chambers into a chamber or space surrounding a motor and a compressor, thereby not only pressing the orbiting scroll member against the stationary scroll member but also cooling the component parts enclosed in the casing.

According to the above-cited U.S. Pat. Nos. 2,881,089, 3,600,114 and 3,884,599, the satisfactory axial sealing between the stationary and orbiting scroll members can be maintained, but they do not propose any means for reducing the frictional losses between them. More specifically, when the springs are interposed between a rotating or moving member (that is, the orbiting scroll member) and a stationary member (that is, the casing), the area of contact between them is inevitably increased and consequently the frictional losses increase. Furthermore, the contact pressure provided by the springs is constant and the coefficient of static friction is greater than the coefficient of rolling friction. In addition, when the scroll compressor is started, the pressure of the gas entrapped between the stationary and orbiting scroll members is low. As a result, there exists a greater difference between the separating force and the pressing force, resulting in an excessive net pressing force. Consequently, the frictional force between the stationary and orbiting scroll members becomes too great to start the scroll compressor.

In the system wherein the partially compressed gas is used to press the orbiting scroll member against the stationary scroll member, the pressure receiving surface area must be restricted so that the pressing and separating forces may be maintained in desired equilibrium. As a result, the construction becomes very complicated.

According to the systems disclosed for instance in the above-recited U.S. applications, Ser. Nos. 887,252 and 967,893, the pressing force of a suitable degree of magnitude can be maintained without causing any adverse effects, but they do not propose any means adequate for sufficiently cooling the component parts enclosed in the casing or the like. As described above, according to U.S. application, Ser. No. 967,893, the gas is forced to flow into the chamber surrounding the motor so that the latter may be cooled. However, the pressure differential between an inlet and an outlet of the chamber is small so that the flow rate of the gas passing through the chamber is low and, consequently, the satisfactory cooling of the motor cannot be attained. It might be suggested to increase the aforementioned pressure differential, but the result would be that, although the flow rate could be increased, the pressure in the chamber would be disturbed and, consequently, the pressing force become nonuniform.

SUMMARY OF THE INVENTION

One of the objects of the present invention is therefore to provide a scroll compressor in which an orbiting scroll member is axially pressed against a stationary scroll member and a motor is satisfactorily cooled.

Another object of the present invention is to provide a scroll compressor in which regardless of the variation in either one or both of the suction and discharge pressures, an orbiting scroll member can be axially pressed against a stationary scroll member under a suitable force.

A further object of the present invention is to provide a scroll compressor in which the cooling of a motor is so satisfactory that a high overall adiabatic efficiency can be attained.

A yet further object of the present invention is to provide a scroll compressor which is very simple in construction.

A still further object of the present invention is to provide a scroll compressor especially adapted for use in a refrigeration cycle such as a refrigerator, a freezer, an air conditioner or the like.

The above and other objects of the present invention can be accomplished by a scroll compressor which is used as a compressor in a refrigeration cycle or for compressing a gas, the compressor unit and its driving motor being enclosed gas-tightly in a casing, the compressed gas discharged from the compressor unit being circulated through component parts such as the motor enclosed in the casing before it flows into a next stage outside of the compressor, the compressor unit being provided with a backpressure chamber into which is introduced a partially compressed gas so as to press an orbiting scroll member against a stationary scroll member, thereby attaining a secure axial seal between them.

BRIEF DESCRIPTION OF THE DRAWINGS

Same reference numerals are used to designate similar parts throughout figures.

DESCRIPTION OF THE PREFERRED EMBODIMENTS

Figure 1:
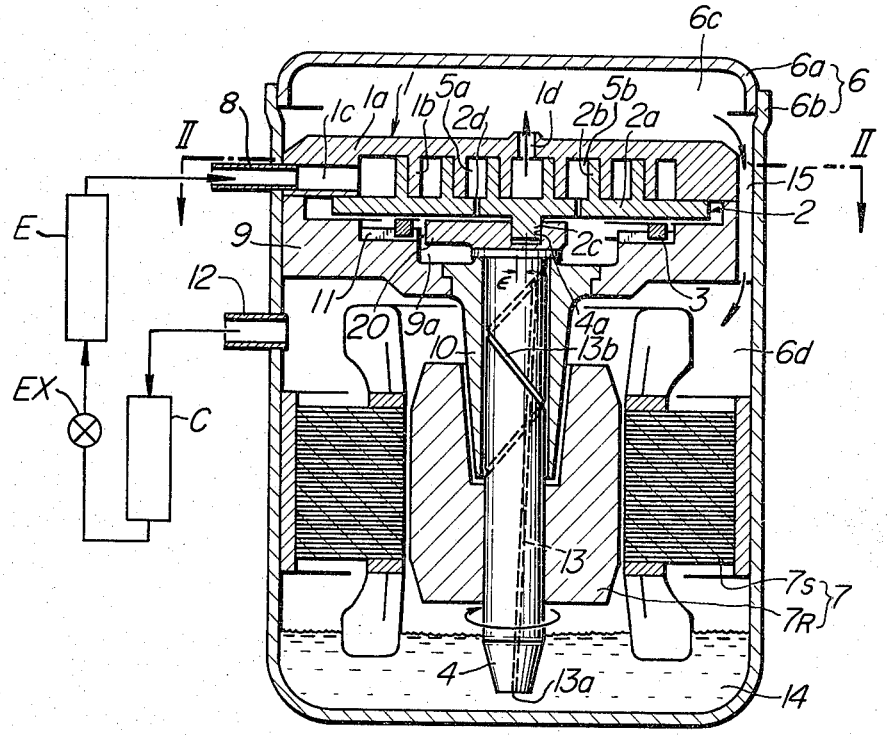
FIG. 1 is a longitudinal sectional view of a first embodiment of the present invention.
Figure 2:
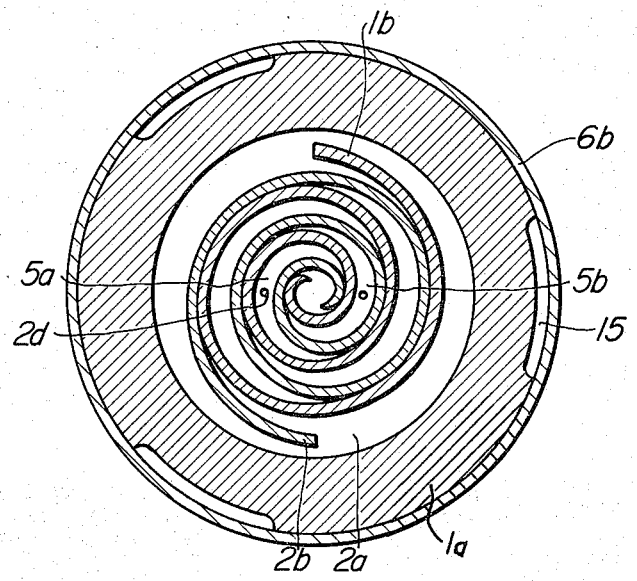
FIG. 2 is a sectional view taken along the line II—II of FIG. 1.

First Embodiment, FIGS. 1 and 2

As shown in FIG. 1, the scroll compressor has an airtight sealed casing 6 comprising an upper casing member or a top cover 6*a* a lower casing member 6*b* housing the parts to be described below.

The casing 6 houses a stationary scroll member 1 consisting of an end plate 1*a* and an involute wrap 1*b* extended axially downwardly and perpendicular to the end plate 1*a*. The stationary scroll member 1 has a discharge port 1*d*, formed through the end plate 1*a* coaxially thereof, and a suction port 1*c*, radially extended through the peripheral wall of the end plate 1*a*, communicated at the outer end with a suction pipe 8 and at the inner end with the space defined between the peripheral wall of the end plate 1*a* and the involute wrap 1*b*.

The casing 6 houses also an orbiting scroll member 2 consisting of an end plate 2*a* and an involute wrap 2*b* extended axially upwardly and perpendicular to the end plate 2*a*. The orbiting scroll member 2 has also a scroll pin 2*c* extended axially downwardly from the undersurface of the end plate 2*a*. The end plate 2*a* is formed with two small holes 2*d* in diametrically opposite relationship as best shown in FIG. 2. These two small holes 2*d* serve as restriction means as will be described in detail below.

Both the involute wraps 1*b* and 2*b* of the stationary and orbiting scroll members 1 and 2 are substantially similar in shape and meshed with each other as is well known in the art.

The casing 6 also houses a frame 9 which is mounted with a few bolts (not shown) to the stationary scroll member 1 and defines a backpressure chamber 9*a* as will be described in detail below.

A crankshaft 4 is rotatably extended through a bearing 10 mounted on the frame 9 in coaxial relationship with the stationary scroll member 1. The flanged upper end of the crankshaft 4 is formed with a balancing weight 20 and a scroll pin receiving hole 4*a* having an axis eccentric to the axis of rotation of the crankshaft 4, with the eccentricity being designated $\epsilon$.

A rotation-preventing member 3 is interposed between the orbiting scroll member 2 and the frame 9. The rotation preventing member 3 includes a flat ring with the upper and lower annular surfaces formed with respective grooves which are extended at right angles to each other. An Oldham key 11, keyed to the frame 9, is inserted into the lower groove of the rotation-prevention member 3. In like manner, an Oldham key (not shown), keyed to the orbiting scroll member 2, is inserted into the upper groove of the member 3.

The stator 7S of a motor 7 is securely attached to the inner wall of the lower casing member 6*b* below a lower chamber 6*d* and the rotor 7R of the motor 7 is securely joined to the crankshaft 4.

The lower chamber 6*d*, defined between the frame 9 and the motor 7, is communicated with a condenser C through a discharge pipe 12 extended radially outwardly through the cylindrical wall of the lower casing member 6*b*.

The crankshaft 4 is provided with a helical circumferential oil groove 13*b* on its periphery and an axial oil passageway 13 which is inclined at an angle with respect to the axis of the crankshaft 4. The upper end of the axial oil passageway 13 is communicated with the helical circumferential oil groove 13*b* at the point adjacent to the upper end thereof and offset from the axis of the crankshaft 4 while the lower end 13*a* of the passageway 13 is opened at the lower end of the crankshaft 4 coaxially thereof.

A lubricant 14 is stored at the bottom of the lower casing member 6*b*.

The scroll compressor with the above-described construction is shown as being inserted in a refrigeration system consisting of the condenser C, an expansion valve EX and an evaporator E.

Next the mode of operation of the first embodiment will be described. The compression of the refrigerant or the like is described in detail in the co-pending U.S. application Ser. No. 967,893 so that no further description shall be made in this specification.

The compressed gas is discharged through the discharge port 1*d* into the upper chamber or space 6*c* defined between the upper casing member 6*a* and the stationary scroll member 1. Thereafter the compressed gas flows into the lower chamber 6*d* through an axial passageway 15 and then into the condenser C through the discharge pipe 12.

The compressed gas discharged through the discharge port 1*d* is raised to relatively high temperatures, but its temperature is considerably lower than the temperature of the motor 7. It follows therefore that when the compressed gas is circulated through the airtight sealed casing 6 in the manner described above, the compressed gas can absorb the heat dissipated from the motor 7 and carry the heat outside of the casing 6, whereby the motor 7 may be cooled.

Meanwhile the backpressure chamber 9a is gas-tight sealed from the upper and lower chambers or spaces 6c and 6d by means of the frame 9, the bearing 10 and the stationary scroll member 1. In addition, the backpressure chamber 9a is communicated through the restrictions or small holes 2d with the intermediate compression chambers 5a and 5b (See FIG. 2), whereby the backpressure chamber 9a is maintained at an intermediate pressure $P_m$ between the pressure $P_s$ of the gas or refrigerant flowing through the suction port 1c into the compressor and the pressure $P_d$ of the compressed gas discharged through the discharge port 1d. The intermediate pressure is, for instance, $P_m = P_s \cdot P_d$. The force acting upwardly on the orbiting scroll member 2 due to this intermediate pressure $P_m$ overcomes the force which tends the orbiting scroll member 2 to move away from the stationary scroll member 1 so that the orbiting scroll member 2 is pressed against the stationary scroll member 1 under the force of an optimum degree of magnitude.

The direction of the helical circumferential oil groove 13b is so selected that when the crankshaft 4 is rotated in the direction indicated by the arrow in FIG. 1, the lubricant 14 is forced to flow downward through the oil groove 13b under the pumping action thereof, whereby the crankshaft 4 is gas- and pressure-tight sealed in the bearing 10. As a result, the backpressure chamber 9a is satisfactorily sealed in a gas-tight manner from the lower chamber 6d.

Figure 3:
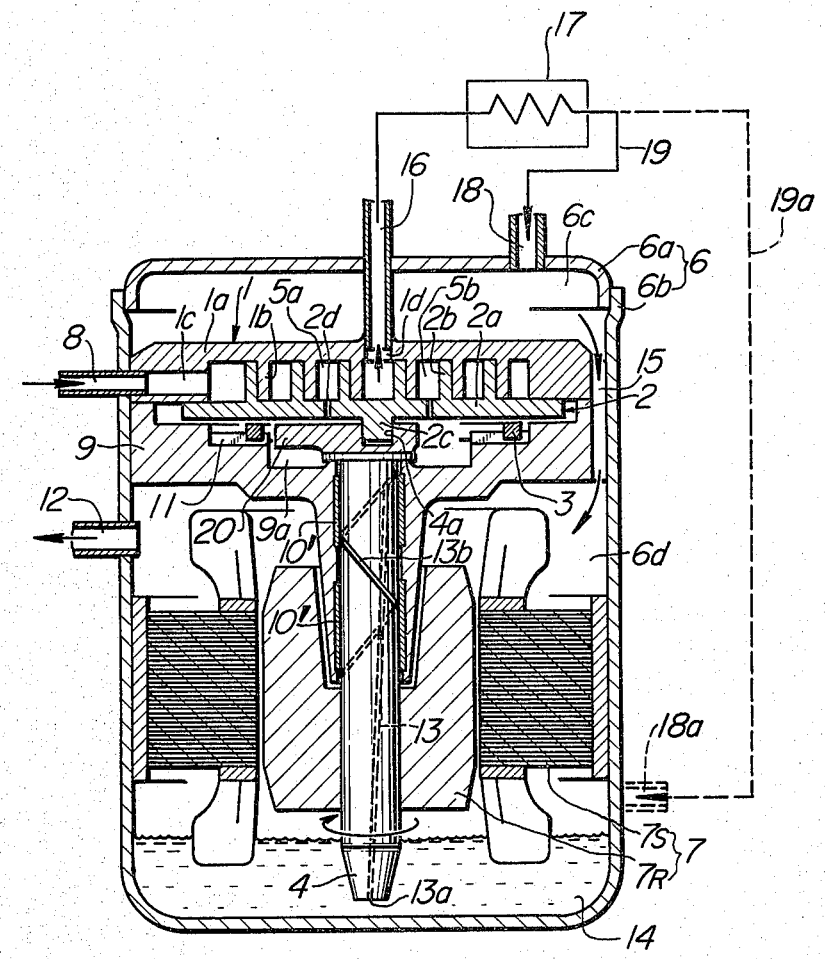
FIG. 3 is a longitudinal sectional view of a second embodiment of the present invention.

Second Embodiment, FIG. 3

As shown in FIG. 3 a scroll compressor in accordance with a second embodiment of the present invention is substantially similar in construction to the first embodiment except that the discharge port 1d is connected to an intermediate pipe 16 or the like extended through the upper chamber 6c and the upper casing member or top cover 6a and is communicated with an intercooler 17. The compressed gas, which has been cooled by the intercooler 17, is returned through a return pipe 19 and a return port 18 into the upper chamber 6c so that the component parts enclosed in the casing 6 can be more effectively cooled as compared with the first embodiment.

Alternatively, the cooled gas may be introduced through a return pipe 19a and a return port 18a into the space below the motor 7 in the casing 6 so that the cooled gas rises through the motor 7 into the lower chamber 6d, whereby the motor 7 may be more effectively cooled.

In summary, according to the present invention, the backpressure chamber 9a can be maintained at an intermediate pressure, for example, $P_m$ so that the orbiting scroll member 2 can be pressed against the stationary scroll member 1 under the force of an optimum magnitude as described in detail above.

In addition, the compressed gas is circulated through the airtight sealed casing 6 before it flows to a next stage so that the heat generated within the casing 6 can be carried out by the compressed gas and dissipated outside of the casing 6 so that the abnormal rise of the inside temperature can be avoided. As a result, the adverse effects such as the insulation breakdown or degradation and the decrease in suction rate due to the abnormal rise of inside temperature can be avoided.

What we claim is:

1. A scroll compressor for use in at least one of a refrigeration cycle and a media compression, the scroll compressor comprising:

a stationary scroll member including an end plate, an involute wrap extending at right angles to said end plate, and a discharge port opened at a starting end of said involute wrap;

an orbiting scroll member comprising an end plate, an involute wrap extending at right angles to said end plate of said orbiting scroll member and in mesh with said involute wrap of said stationary scroll member;

a suction port;

a rotation-preventing means for preventing a rotation of said orbiting scroll member;

a frame means jointed to said end plate of said stationary scroll member on a side in which is extended said involute wrap, said frame means defining a space in which said orbiting scroll member and a backpressure chamber is disposed;

a driving shaft extending through said frame means;

bearing means having at least a bearing mounted on said frame to support said driving shaft, said bearing means being disposed so as to be exposed to the backpressure chamber at one end thereof and to an exterior of said frame member at the other end thereof, said bearing means cooperating with said frame means and said driving shaft to seal the backpressure chamber from the exterior of the frame means;

a balancing weight means;

a power transmission means for transmitting a rotation of said driving shaft at a position offset from an axis of rotation thereof to said orbiting scroll member so as to cause an orbiting motion thereof;

a motor means drivingly coupled to said driving shaft;

a casing means for enclosing therein said stationary and orbiting scroll members, said frame means, said bearing means, said driving shaft, and said motor means in a gas-tight manner;

a compressed media discharged through said discharge port being circulated through an interior of said casing means before the media flows into a next stage; and means for connecting said back pressure chamber with intermediate compression chambers defined between said stationary and orbiting scroll members.

2. A scroll compressor as set forth in claim 1, wherein said driving shaft is provided with at least one helical circumferential oil groove disposed at least in a cylindrical outer surface thereof in opposed relationship with a cylindrical bore surface of said bearing means, a direction of said helical circumferential oil groove is so selected that a lubricant is forced to flow from said backpressure chamber to the interior of said casing means under a pumping action of said helical circumferential oil groove.

3. A scroll compressor as set forth in one of claims 1 or 2 wherein said suction port is connected to a suction pipe;

said discharge port is opened at the interior of said casing means;

a discharge pipe is connected to said casing means; and a series circuit including a condenser, an expansion means and an evaporator interconnected between said discharge and suction pipes.

4. A scroll compressor as set forth in one of claims 1 or 2, wherein an intermediate discharge pipe means is provided for communicating said discharge port with an intercooler disposed outside of said casing means, said intermediate discharge pipe means extends through and beyond said casing means; and a return pipe means is provided for communicating a discharge port of said intercooler with the interior of said casing means.

5. A scroll compressor as set forth in claim 4 wherein said return pipe means is connected to said casing means adjacent to a bottom thereof.

6. A scroll compressor as set forth in claim 1, wherein said means for communicating said backpressure chamber with said intermediate compression chambers include a plurality of fine-diameter holes which function as restriction means, the plurality of holes are formed axially through said end plate of said orbiting scroll member.

7. A scroll compressor as set forth in one of claims 1, 2, or 6 wherein said stationary and orbiting scroll members and said rotation-preventing means form a compression unit, the compression unit is disposed in an upper portion of said casing means, and wherein said motor means is disposed in a lower portion of said casing means.

8. A scroll compressor as set forth in claim 3, wherein said stationary and orbiting scroll members and said rotation-preventive means form a compression unit, the compression unit is disposed in an upper portion of said casing means, and wherein said motor means is disposed in a lower portion of said casing means.

9. A scroll compressor as set forth in claim 4, wherein said stationary and orbiting scroll members and said rotation-preventing means form a compression unit, the compression unit is disposed in an upper portion of said casing means, and wherein said motor means is disposed in a lower portion of said casing means.

10. A scroll compressor as set forth in claim 5, wherein said stationary and orbiting scroll members and said rotation-preventing means form a compression unit, the compression unit is disposed in an upper portion of said casing means, and wherein said motor means is disposed in a lower portion of said casing means.

11. A scroll compressor as set forth in claim 6, wherein said means for communicating said backpressure chamber with said intermediate compression chambers includes two holes formed through said end plate of said orbiting scroll member, said two holes being located at positions such that a pressure $P_m$ in the backpressure chamber satisfies the following relationship;

$$P_m = \sqrt{Ps \cdot Pd}\ ;$$

where:

Ps is a suction pressure; and

Pd is a discharge pressure.

* * * * *